US007034770B2

(12) United States Patent
Yang et al.

(10) Patent No.: US 7,034,770 B2
(45) Date of Patent: Apr. 25, 2006

(54) PRINTED DIPOLE ANTENNA

(75) Inventors: Hung Yu David Yang, Los Angeles, CA (US); Jesus A Castaneda, Los Angeles, CA (US)

(73) Assignee: Broadcom Corporation, Irvine, CA (US)

( * ) Notice: Subject to any disclaimer, the term of this patent is extended or adjusted under 35 U.S.C. 154(b) by 0 days.

(21) Appl. No.: 10/842,604

(22) Filed: May 10, 2004

(65) Prior Publication Data

US 2004/0207563 A1 Oct. 21, 2004

Related U.S. Application Data

(63) Continuation of application No. 10/128,192, filed on Apr. 23, 2002, now Pat. No. 6,753,825.

(51) Int. Cl.
*H01Q 9/16* (2006.01)
*H01Q 1/38* (2006.01)

(52) U.S. Cl. ..... 343/793; 343/700 MS

(58) Field of Classification Search ..... 343/795, 343/700 MS, 793
See application file for complete search history.

(56) References Cited

U.S. PATENT DOCUMENTS

| | | | | |
|---|---|---|---|---|
| 3,949,407 | A * | 4/1976 | Jagdmann et al. | 343/895 |
| 5,285,210 | A * | 2/1994 | Sato et al. | 343/713 |
| 5,598,168 | A * | 1/1997 | Evans et al. | 343/700 MS |
| 6,222,494 | B1 * | 4/2001 | Erkocevic | 343/790 |
| 6,529,749 | B1 * | 3/2003 | Hayes et al. | 455/575.7 |
| 2002/0021253 | A1 * | 2/2002 | Muramoto et al. | 343/702 |
| 2002/0101383 | A1 * | 8/2002 | Junod | 343/742 |
| 2002/0101393 | A1 * | 8/2002 | Junod | 343/742 |
| 2002/0109639 | A1 * | 8/2002 | Hung et al. | 343/820 |
| 2003/0146874 | A1 * | 8/2003 | Kane et al. | 343/702 |

* cited by examiner

*Primary Examiner*—Shih-Chao Chen
*Assistant Examiner*—Angela M Lie
(74) *Attorney, Agent, or Firm*—Garlick Harrison & Markison LLP; Timothy W. Markison

(57) ABSTRACT

A printed dipole antenna includes a metal trace having first type sections and second type sections, wherein currents within the first type sections substantially cancel and currents the second type sections are substantially cumulative.

7 Claims, 7 Drawing Sheets antenna 86 printed antenna 86 antenna 86

1/2 wavelength current antenna 86

1 wavelength current

PRINTED DIPOLE ANTENNA

This patent application is claiming priority under 35 USC § 120 to and is a continuation of co-pending patent application entitled PRINTED ANTENNA AND APPLICATIONS THEREOF, having a Ser. No. of 10/128,192, and a filing date of Apr. 23, 2002 now U.S. Pat. No. 6,753,825.

TECHNICAL FIELD OF THE INVENTION

This invention relates generally to wireless communications and more particularly to antennas used within such wireless communication systems.

BACKGROUND OF THE INVENTION

As is known, an antenna is an essential element for every wireless communication device regardless of what type of wireless communication system the device is used in. The antenna provides a wireless interface for the wireless communication device, which may be a radio, cellular telephone, pager, station (for wireless local area network, wireless internet, et cetera). The particular type of wireless communication system, which prescribes the transmission frequencies, reception frequencies and power levels, dictates the performance requirements for the antenna.

Since most wireless communication devices are handheld or portable devices, each component comprising these devices must be small, efficient, economical and lightweight. The antenna is no exception; it too must be small, efficient, economical and lightweight. To achieve these requirements, many antenna have been developed having various structures including dipole, patch, inverted F, L, et cetera.

In recent years, fabricating an antenna on a printed circuit board has become popular for low power systems due to its low cost and low profile. Such printed circuit board antennas are shaped as rectangles, circles, triangles, or strips and may be modified with notches or slits. The particular shape of an antenna is typically based on the application. For example, an L shaped strip or meandering strips are typically used for wireless local area network applications.

To provide signals to and/or receive signals from a printed circuit board antenna, a feed is used. Such a feed may be a coaxial cable or printed transmission line feed. In most instances, the feed is considered part of an antenna assembly.

While the various types of antennas and corresponding shapes provide adequate antenna performance, they are not optimized to consume the smallest printed circuit board real estate possible nor are they optimized for maximum bandwidth. Therefore, a need exists for a printed antenna that optimizes both size (i.e., achieves smallest size possible) and bandwidth.

SUMMARY OF THE INVENTION

The printed dipole antenna disclosed herein substantially meets these needs and others. In one embodiment, a printed dipole antenna includes a metal trace having first type sections and second type sections, wherein currents within the first type sections substantially cancel and currents the second type sections are substantially cumulative.

DETAILED DESCRIPTION OF A PREFERRED EMBODIMENT

Figure 1:
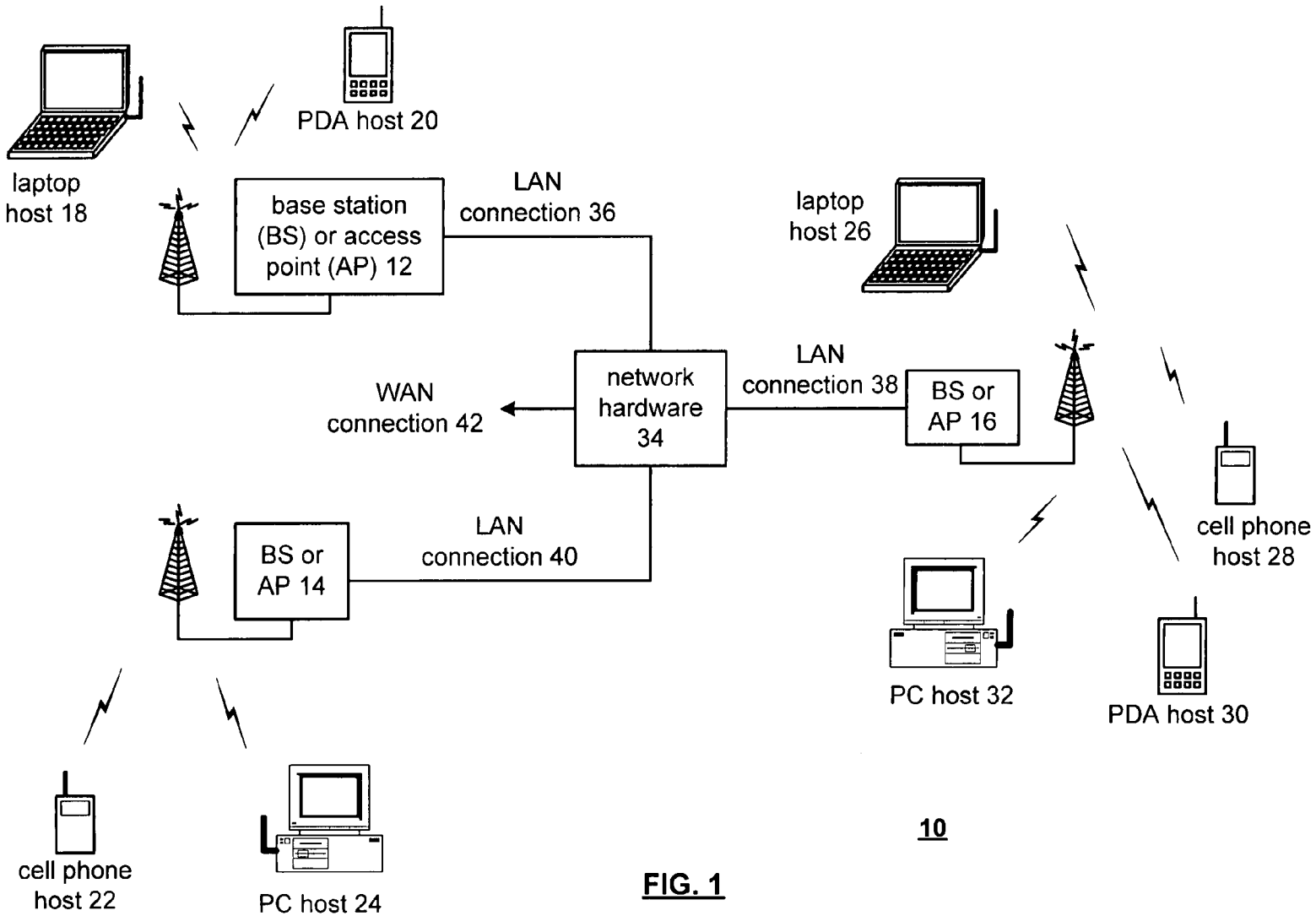
FIG. 1 illustrates a schematic block diagram of a wireless communication system in accordance with the present invention.

FIG. 1 illustrates a schematic block diagram of a communication system 10 that includes a plurality of base stations and/or access points 12–16, a plurality of wireless communication devices 18–32 and a network hardware component 34. The wireless communication devices 18–32 may be laptop host computers 18 and 26, personal digital assistant hosts 20 and 30, personal computer hosts 24 and 32 and/or cellular telephone hosts 22 and 28. The details of the wireless communication devices will be described in greater detail with reference to FIG. 2.

The base stations or access points 12 are operably coupled to the network hardware 34 via local area network connections 36, 38 and 40. The network hardware 34, which may be a router, switch, bridge, modem, system controller, et cetera provides a wide area network connection 42 for the communication system 10. Each of the base stations or access points 12–16 has an associated antenna or antenna array to communicate with the wireless communication devices in its area. Typically, the wireless communication devices register with a particular base station or access point 12–14 to receive services from the communication system 10. For direct connections (i.e., point-to-point communications), wireless communication devices communicate directly via an allocated channel.

Typically, base stations are used for cellular telephone systems and like-type systems, while access points are used for in-home or in-building wireless networks. Regardless of the particular type of communication system, each wireless communication device includes a built-in radio and/or is coupled to a radio. The radio includes a self-calibrating transmitter as disclosed herein to enhance performance for a direct conversion transmitter that has characteristics of reduced costs, reduced size, etc.

Figure 2:
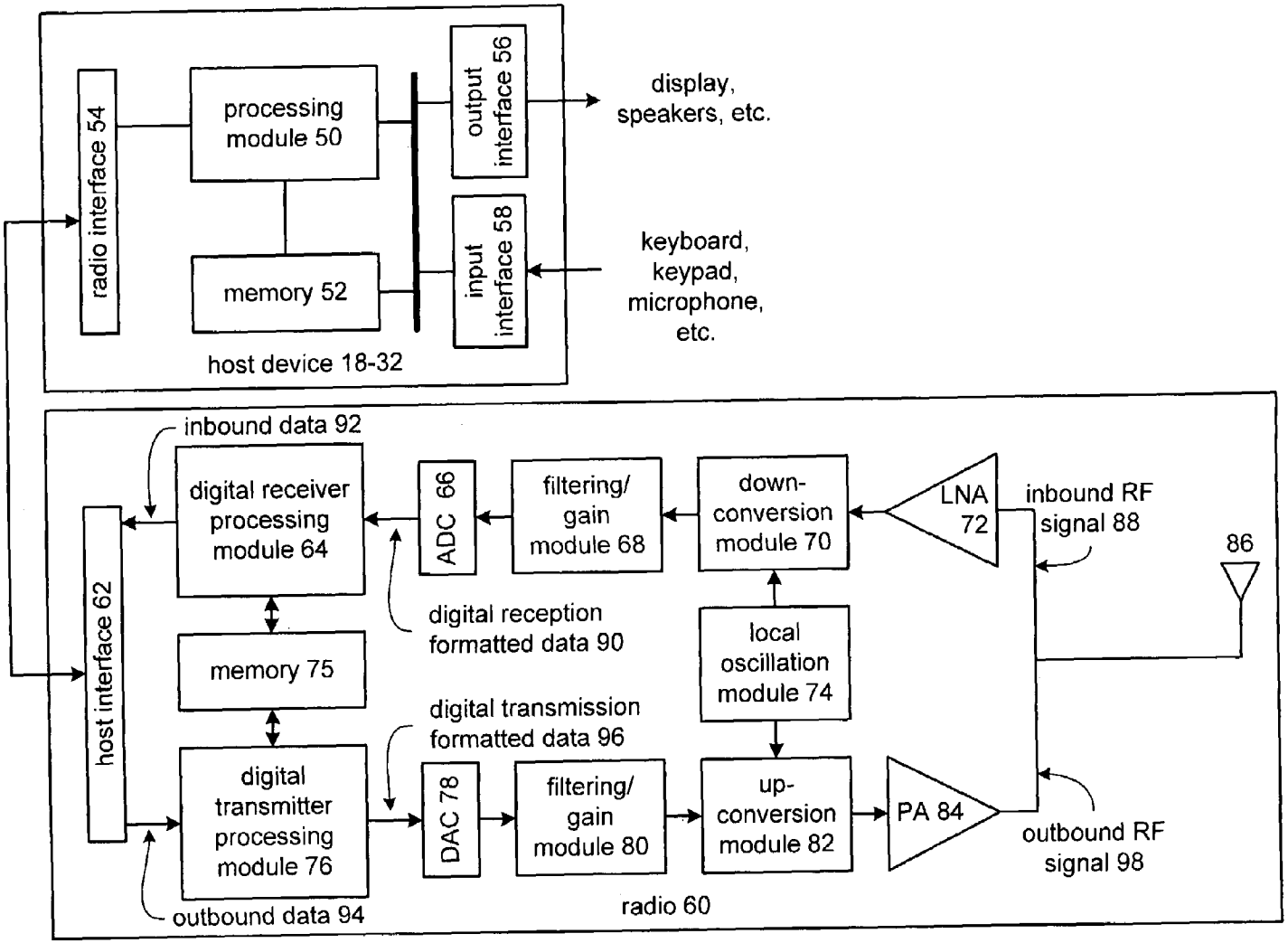
FIG. 2 illustrates a schematic block diagram of a wireless communication device in accordance with the present invention.

FIG. 2 illustrates a schematic block diagram of a wireless communication device that includes the host device 18–32 and an associated radio 60. For cellular telephone hosts, the radio 60 is a built-in component. For personal digital assistants hosts, laptop hosts, and/or personal computer hosts, the radio 60 may be built-in or an externally coupled component.

As illustrated, the host device 18–32 includes a processing module 50, memory 52, radio interface 54, input interface 58 and output interface 56. The processing module 50 and memory 52 execute the corresponding instructions that are typically done by the host device. For example, for a cellular telephone host device, the processing module 50 performs the corresponding communication functions in accordance with a particular cellular telephone standard.

The radio interface 54 allows data to be received from and sent to the radio 60. For data received from the radio 60 (e.g., inbound data), the radio interface 54 provides the data to the processing module 50 for further processing and/or routing to the output interface 56. The output interface 56 provides connectivity to an output display device such as a display, monitor, speakers, et cetera such that the received data may be displayed. The radio interface 54 also provides data from the processing module 50 to the radio 60. The processing module 50 may receive the outbound data from an input device such as a keyboard, keypad, microphone, et cetera via the input interface 58 or generate the data itself. For data received via the input interface 58, the processing module 50 may perform a corresponding host function on the data and/or route it to the radio 60 via the radio interface 54.

Radio 60 includes a host interface 62, digital receiver processing module 64, analog-to-digital converter 66, filtering/gain module 68, down conversion module 70, low noise amplifier 72, local oscillation module 74, memory 75, digital transmitter processing module 76, digital-to-analog converter 78, filtering/gain module 80, up-conversion module 82, power amplifier 84, and an antenna 86. The antenna 86 may be a single antenna that is shared by the transmit and receive paths or may include separate antennas for the transmit path and receive path. The antenna implementation will depend on the particular standard to which the wireless communication device is compliant and will be described in greater detail with reference to FIGS. 3–11.

The digital receiver processing module 64 and the digital transmitter processing module 76, in combination with operational instructions stored in memory 75, execute digital receiver functions and digital transmitter functions, respectively. The digital receiver functions include, but are not limited to, digital intermediate frequency to baseband conversion, demodulation, constellation demapping, decoding, and/or descrambling. The digital transmitter functions include, but are not limited to, scrambling, encoding, constellation mapping, modulation, and/or digital baseband to IF conversion. The digital receiver and transmitter processing modules 64 and 76 may be implemented using a shared processing device, individual processing devices, or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on operational instructions. The memory 75 may be a single memory device or a plurality of memory devices. Such a memory device may be a read-only memory, random access memory, volatile memory, non-volatile memory, static memory, dynamic memory, flash memory, and/or any device that stores digital information. Note that when the processing module 64 and/or 76 implements one or more of its functions via a state machine, analog circuitry, digital circuitry, and/or logic circuitry, the memory storing the corresponding operational instructions is embedded with the circuitry comprising the state machine, analog circuitry, digital circuitry, and/or logic circuitry.

In operation, the radio 60 receives outbound data 94 from the host device via the host interface 62. The host interface 62 routes the outbound data 94 to the digital transmitter processing module 76, which processes the outbound data 94 in accordance with a particular wireless communication standard (e.g., IEEE802.11a, IEEE802.11b, Bluetooth, et cetera) to produce digital transmission formatted data 96. The digital transmission formatted data 96 will be a digital base-band signal or a digital low IF signal, where the low IF will be in the frequency range of zero to a few megahertz.

The digital-to-analog converter 78 converts the digital transmission formatted data 96 from the digital domain to the analog domain. The filtering/gain module 80 filters and/or adjusts the gain of the analog signal prior to providing it to the up-conversion module 82. The up-conversion module 82 directly converts the analog baseband or low IF signal into an RF signal based on a transmitter local oscillation provided by local oscillation module 74. The power amplifier 84 amplifies the RF signal to produce outbound RF signal 98. The antenna 86 transmits the outbound RF signal 98 to a targeted device such as a base station, an access point and/or another wireless communication device.

The radio 60 also receives an inbound RF signal 88 via the antenna 86, which was transmitted by a base station, an access point, or another wireless communication device. The antenna 86 provides the inbound RF signal 88 to the low noise amplifier 72, which amplifies the signal 88 to produce an amplified inbound RF signal. The low noise amplifier 72 provide the amplified inbound RF signal to the down conversion module 70, which directly converts the amplified inbound RF signal into an inbound low IF signal based on a receiver local oscillation provided by local oscillation module 74. The down conversion module 70 provides the inbound low IF signal to the filtering/gain module 68, which filters and/or adjusts the gain of the signal before providing it to the analog to digital converter 66.

The analog-to-digital converter 66 converts the filtered inbound low IF signal from the analog domain to the digital domain to produce digital reception formatted data 90. The digital receiver processing module 64 decodes, descrambles, demaps, and/or demodulates the digital reception formatted data 90 to recapture inbound data 92 in accordance with the particular wireless communication standard being implemented by radio 60. The host interface 62 provides the recaptured inbound data 92 to the host device 18–32 via the radio interface 54.

Figure 3:
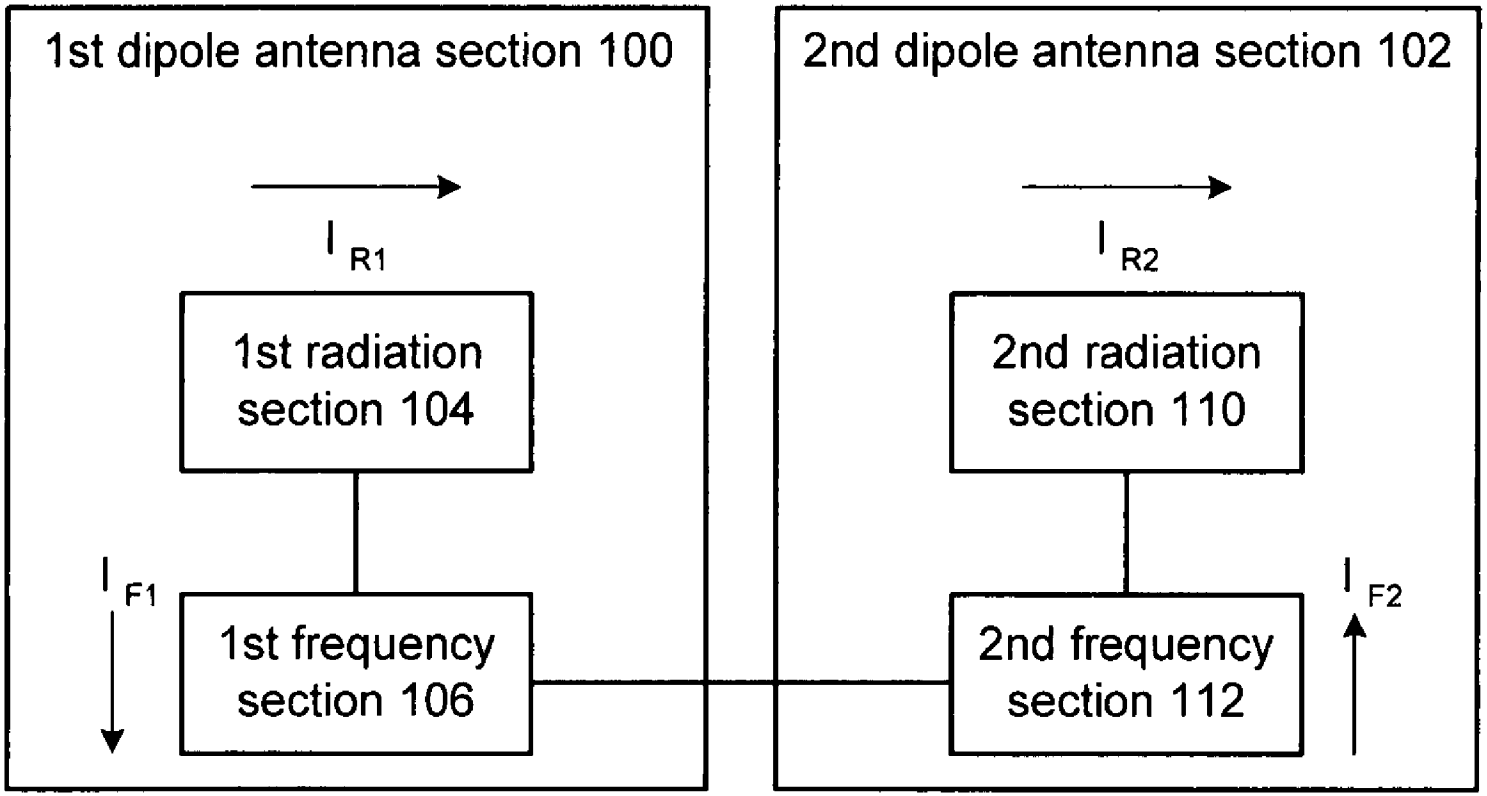
FIG. 3 illustrates a schematic block diagram of a printed antenna in accordance with the present invention.

FIG. 3 illustrates a printed antenna 86 that includes a $1^{st}$ dipole antenna section 100 and a $2^{nd}$ dipole antenna section 102. The $1^{st}$ dipole antenna section 100 includes a $1^{st}$ radiation section 104 and a $1^{st}$ frequency section 106. The $2^{nd}$ dipole antenna section 102 includes a $2^{nd}$ radiation section 110 and a $2^{nd}$ frequency section 112.

In this implementation of the printed antenna 86, which may be printed on a printed circuit board or integrated circuit, the cumulative length of the $1^{st}$ and $2^{nd}$ dipole antenna sections 100 and 102 correspond to a half wavelength. As such, the $1^{st}$ and $2^{nd}$ radiation sections 104 and 110 have a current ($I_{R1}$ and $I_{R2}$) flowing in a like direction.

The $1^{st}$ and $2^{nd}$ frequency sections 106 and 112 have currents ($I_{F1}$ and $I_{F2}$) flowing in opposite directions. As such, the current flowing through the radiation sections 104 and 110 are cumulative while the currents flowing through the $1^{st}$ and $2^{nd}$ frequency sections 106 and 112 are subtractive. As such, the energy radiating from the printed antenna 86 corresponds to the current flowing through the $1^{st}$ and $2^{nd}$ radiation sections 104 and 110. The shaping of the radiation section 104 and frequency section 110 and corresponding radiation section 110 and frequency section 112, is done to obtain the desired current level in the radiation section and to have a cumulative length equal to one-half the wavelength of the transmission frequency or reception frequency.

The printed antenna 86 may be implemented on one or more printed circuit board layers and/or one or more integrated circuit layers. The geometric shaping of the $1^{st}$ and $2^{nd}$ frequency sections may be symmetrical as well as the geometric shapings of the $1^{st}$ and $2^{nd}$ radiation sections. The printed antenna 86 may be further enhanced by including a ground plane that is positioned on another layer wherein the ground plane is substantially parallel to the printed antenna 86. As one of a verage skill in the art will appreciate, the coupling to the printed antenna 86 may be direct or indirect and positioned anywhere on the printed antenna to achieve a desired load impedance.

Figure 4:
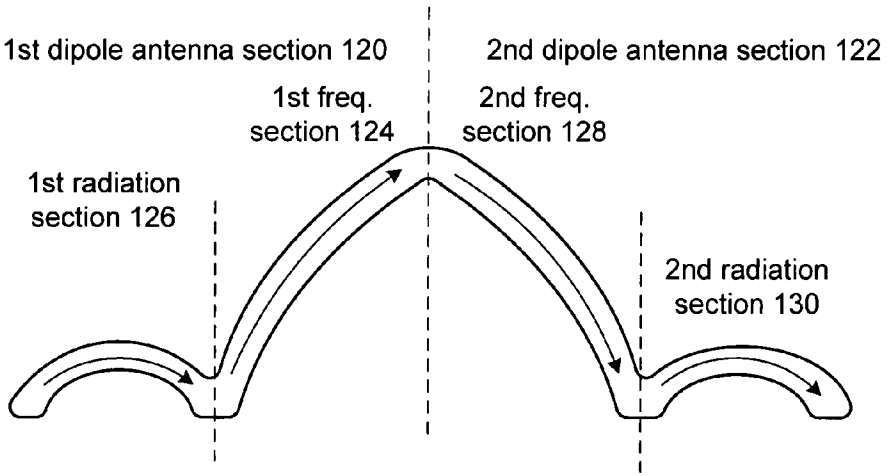
FIG. 4 illustrates a diagram depicting an alternate printed antenna in accordance with the present invention.

FIG. 4 illustrates a printed antenna 86 including an $1^{st}$ dipole antenna section 120 and a $2^{nd}$ dipole antenna section 122. The $1^{st}$ dipole antenna section 120 includes a $1^{st}$ radiation section 126 and a $1^{st}$ frequency section 124. The $2^{nd}$ dipole antenna section 122 includes a $2^{nd}$ frequency section 128 and a $2^{nd}$ radiation section 130. The collective geometry of the $1^{st}$ and $2^{nd}$ dipole antenna sections approximate that of a sinX/X waveform wherein the total length is approximately one-half wavelength of the transmission and/or reception frequencies. The particular shape corresponds to a truncated sinX/X function where X is limited between+ "a" and −"a", where "a" is a finite number along the inner periphery of the antenna 86. The outer periphery of the antenna 86 is based on maintaining an equal width throughout the antenna. The width may vary depending on the particular application and the desired impedance level of the antenna. Current flows through the antenna 86 as indicated by the arrows.

Figure 5:
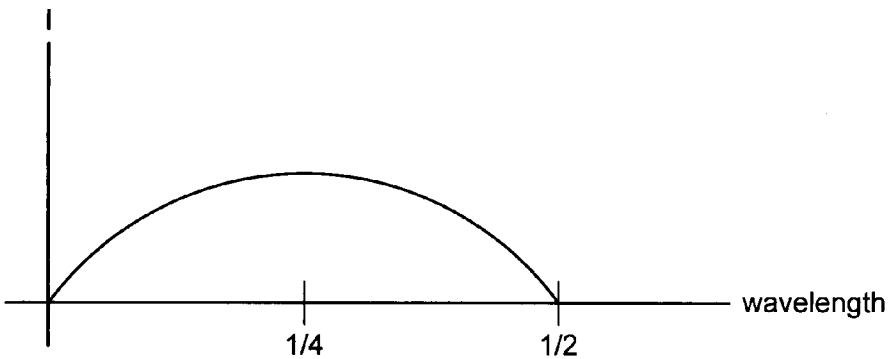
FIG. 5 illustrates a graph depicting current versus wavelength in a half wavelength printed antenna in accordance with the present invention.

For the half wavelength antenna 86 of FIG. 4, the current waveform is depicted in FIG. 5. As shown, no current flows at the end points of the antenna and maximum energy is approximately at ¼ wavelength. This is typically referred to as an odd mode of operation and with the antenna configured as a sinX/X function, its input resistance is substantially smaller than a corresponding straight strip dipole antenna. In addition, the sinX/X waveform provides the dipole function in as minimal of real estate as possible in comparison to prior configurations of dipole antennas.

Figure 6:
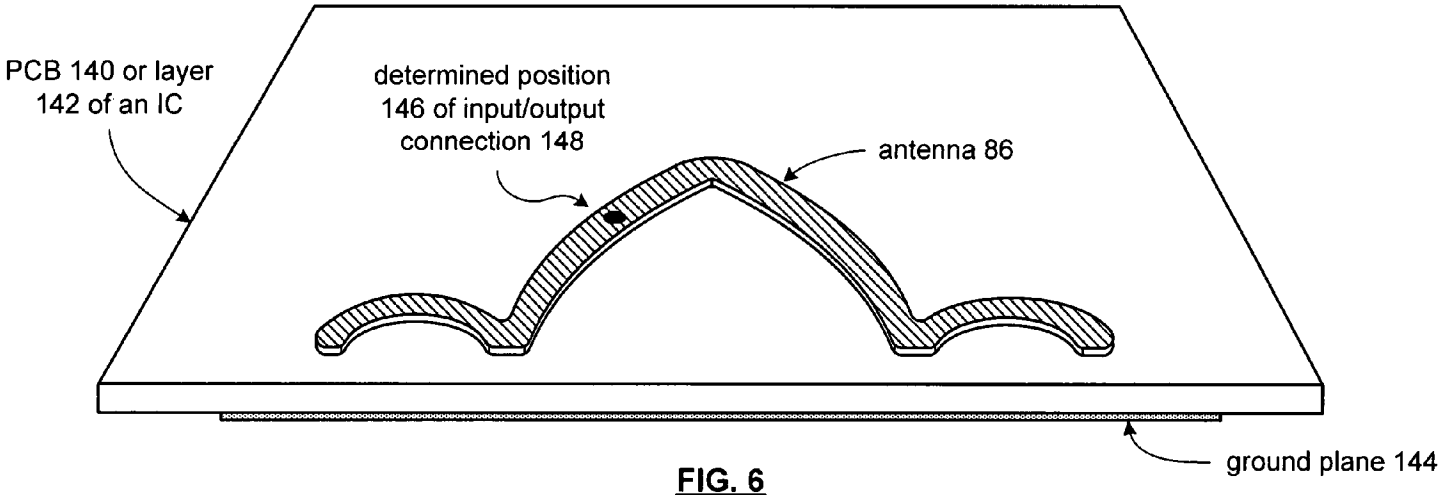
FIG. 6 illustrates a printed antenna including a ground plane and a predetermined position for an input/output connection in accordance with the present invention.

FIG. 6 illustrates a diagram of the printed antenna 86 on a printed circuit board 140 or a layer 142 of an integrated circuit. The printed antenna 86 may be enhanced by including a ground plane 140 on another layer of the printed circuit board 140 or another layer of the integrated circuit. The antenna includes a predetermined position 146 for an input/output connection 148. The determination of the particular position 146 is based on establishing a desired load impedance for the antenna. As such, the position may be in any portion of the printed antenna 86.

Figure 7:
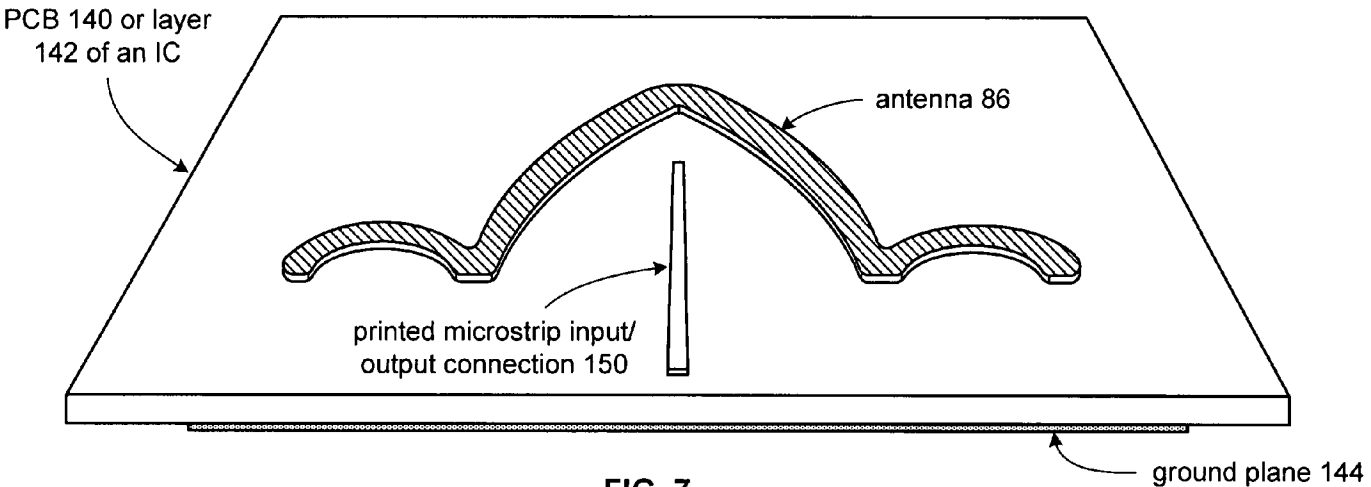
FIG. 7 illustrates a printed antenna that includes a printed micro-strip input/output connection in accordance with the present invention.

FIG. 7 illustrates the antenna 86 including a printed micro-strip input/output connection 150. As shown, the printed micro-strip input/output connection 150 does not physically touch the printed antenna 86. The printed micro-strip input/output connection 150 is located at a predetermined position to provide the desired impedance matching. As one of average skill in the art will appreciate, the printed micro-strip input/output connection 150 may be on the same layer as the printed antenna or on a different layer.

Figure 8:
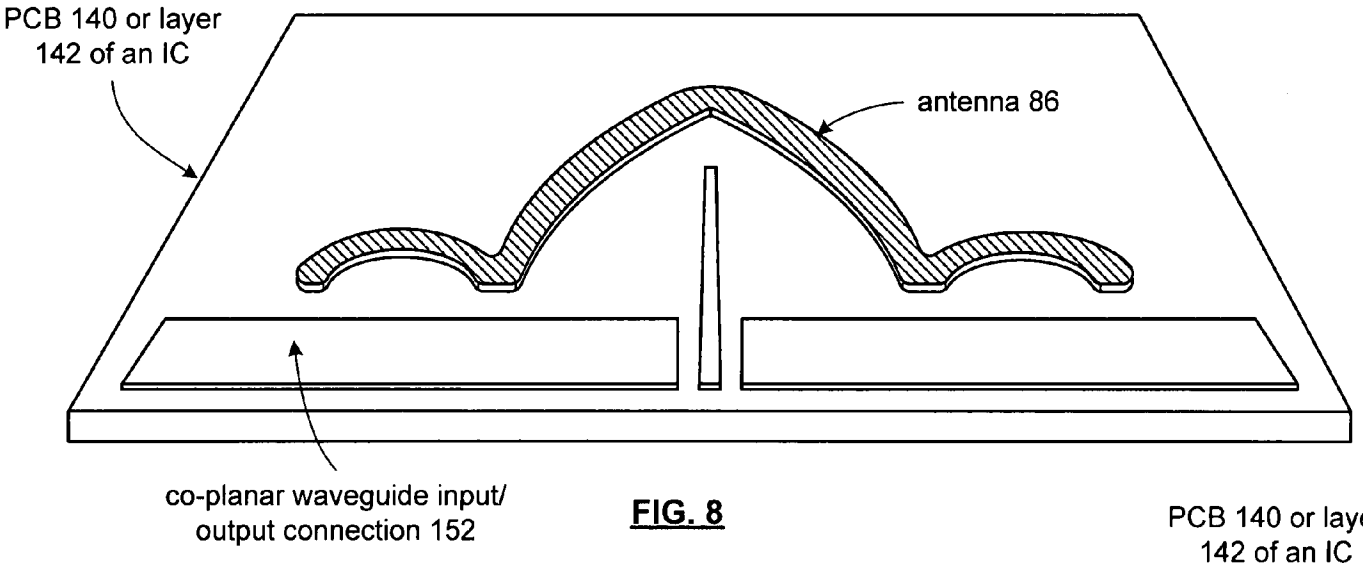
FIG. 8 illustrates a diagram of a printed antenna including a coplanar wave-guide input/output connection in accordance with the present invention.

FIG. 8 illustrates the printed antenna 86 including a coplanar waveguide input/output connection 152. In this embodiment, the antenna 86 does not include a ground plane. The coplanar wave-guide input/output connection is on the same surface as the antenna 14 or may be on the opposite side of the layer. The positioning of the coplanar wave-guide input/output connection is at a predetermined location to provide the desired impedance matching for the printed antenna 86.

Figure 9:
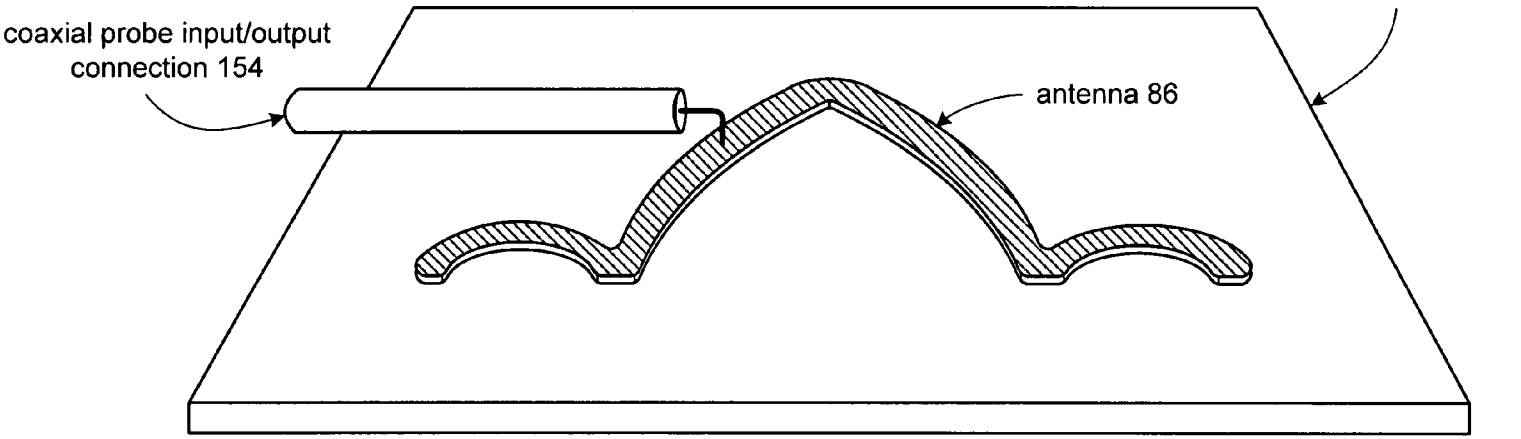
FIG. 9 illustrates a diagram of a printed antenna including a coaxial probe input/output connection in accordance with the present invention.

FIG. 9 illustrates the printed antenna 86 including a coaxial probe input/output connection 154. In this embodiment, the input/output connection is a direct connection to the antenna at a predetermined location to provide the desired impedance matching. In this embodiment, the antenna may or may not include a ground plane on the opposite side of the printed circuit board 140 or layer 142.

Figure 10:
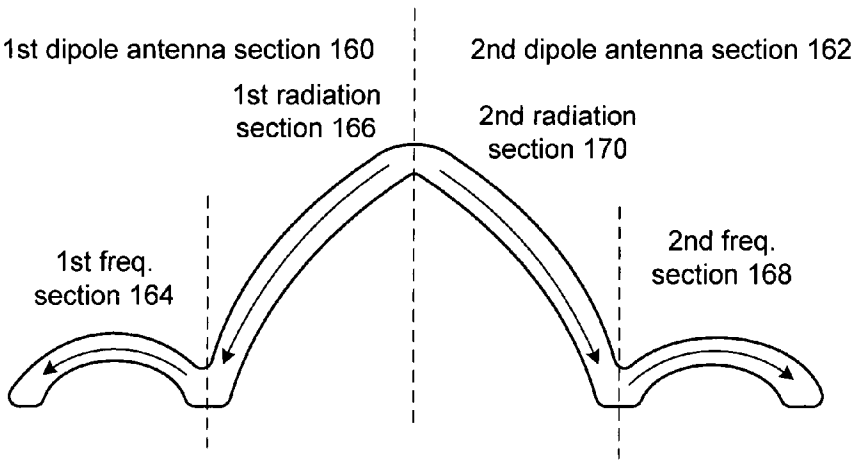
FIG. 10 illustrates a diagram of a full wavelength printed antenna in accordance with the present invention.
Figure 11:
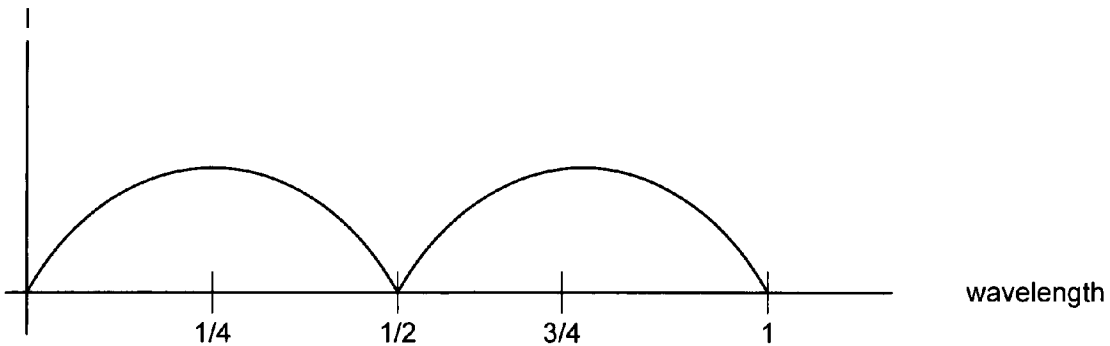
FIG. 11 illustrates a graph depicting current versus wavelength for a full wavelength antenna.

FIG. 10 illustrates a printed antenna 86 that includes a sinX/X waveform having a 1-wavelength. The antenna 86 includes a $1^{st}$ dipole antenna section 160 and a $2^{nd}$ dipole antenna section 162. The $1^{st}$ dipole antenna section 160 includes a $1^{st}$ frequency section 164 and a $1^{st}$ radiation section 166. The $2^{nd}$ dipole antenna section 162 includes a $2^{nd}$ radiation section 170 and a $2^{nd}$ frequency section 168. Simultaneously viewing of FIGS. 10 and 11 illustrate the physical current flow within the antenna 86 as indicated by the arrows in FIG. 10 and the waveform of the current in FIG. 11. As shown at the end points and at the half wavelength point, the current is zero. The current is maximized at the ¼ wavelength points. In this instance, the current in the $1^{st}$ and $2^{nd}$ radiation sections 166 and 168 are cumulative while the currents in the $1^{st}$ and $2^{nd}$ frequency sections 164 are subtractive. As such, the energy radiating from the antenna 86 or being received by antenna 86 corresponds to the current in the $1^{st}$ and $2^{nd}$ radiation sections 166 and 170. As one of average skill in the art will appreciate, the input/output connection to antenna 86 may be done as previously described with reference to FIGS. 6–9.

The preceding discussion has presented a printed antenna that may be implemented on a printed circuit board and/or integrated circuit. By utilizing a specific geometry, the performance characteristics of the antenna are enhanced while minimizing the real estate required to implement the antenna. As one of average skill in the art will appreciate, other embodiments may be derived from the teaching of the present invention, without deviating from the scope of the claims.

What is claimed is:

1. A printed dipole antenna comprises:

a metal trace having first type sections and second type sections, wherein currents within the first type sections substantially cancel and currents the second type sections are substantially cumulative, wherein the metal trace has a geometric shape that approximates a sinX/X waveform and where X is limited between +"a" and −"a" wherein "a" is a finite number along the inner periphery of the antenna.

2. The printed dipole antenna of claim 1 further comprises at least one of:

the metal trace being formed on at least one layer of a printed circuit board; and the metal trace being formed on at least one layer of an integrated circuit.

3. The printed dipole antenna of claim 1 further comprises:

the metal traces has a length of approximately one-half wavelength of a frequency of signals received or transmitted via the printed dipole antenna.

4. The printed dipole antenna of claim 1 further comprises:

a ground plane printed on another layer and is substantially parallel to the printed dipole antenna.

5. A radio comprises:

receiver section;

transmitter section;

printed antenna; and antenna switch operable to connect either the receiver section or the transmitter section to the printed antenna, wherein the printed dipole antenna includes:

a metal trace having first type sections and second type sections, wherein currents within the first type sections substantially cancel and currents the second type sections are substantially cumulative, wherein the metal trace has a geometric shape that approximates a sinX/X waveform and where X is limited between +"a" and −"a" wherein "a" is a finite number along the inner periphery of the antenna.

6. The radio of claim 5, wherein the printed antenna further comprises:

the metal trace having a length of approximately one-half wavelength of a frequency of signals received or transmitted via the printed dipole antenna.

7. The radio of claim 5, wherein the printed dipole antenna further comprises:

a ground plane printed on another layer and is substantially parallel to the printed dipole antenna.

* * * * *